United States Patent [19]

Hettes

[11] Patent Number: 4,457,040

[45] Date of Patent: Jul. 3, 1984

[54] INDUSTRIAL WIRE CUP-SHAPED BRUSH

[75] Inventor: Frank J. Hettes, Greentown, Pa.

[73] Assignee: Weiler Brush Company, Cresco, Pa.

[21] Appl. No.: 456,963

[22] Filed: Jan. 10, 1983

Related U.S. Application Data

[63] Continuation-in-part of Ser. No. 294,500, Aug. 20, 1981, abandoned.

[51] Int. Cl.[3] ..... A46B 13/02

[52] U.S. Cl. ..... 15/180; 15/198

[58] Field of Search ..... 15/180, 198, 200, 28, 15/29, 49 R, 50 R; 29/125

[56] References Cited

U.S. PATENT DOCUMENTS 2,062,047 11/1936 Bickel et al. ..... 15/180

2,480,877 9/1949 Peterson ..... 15/180

3,370,313 2/1968 Nelson ..... 15/180 X

FOREIGN PATENT DOCUMENTS 1088155 9/1954 France ..... 15/180

*Primary Examiner*—Peter Feldman

*Attorney, Agent, or Firm*—Brumbaugh, Graves, Donohue & Raymond

[57] ABSTRACT

An industrial cup-shaped brush in which both inward and outward pivotal movements of the wire bristles caused by scrubbing or rotary motions is effectively resisted by providing elongated supports on the knot plate for the wire bristles and anchoring the bristles to the elongated supports by elongated loops of generally complementary shape to the elongated supports.

3 Claims, 4 Drawing Figures

INDUSTRIAL WIRE CUP-SHAPED BRUSH

This application is a continuation-in-part of my copending application Ser. No. 294,500, filed Aug. 20, 1981, now abandoned.

The invention relates to an industrial wire cup-shaped brush of the type in which relatively rigid wire bristles are looped through holes in a cup-shaped knot plate for rotary or scrubbing action on a surface.

In industrial wire cup-shaped brushes, it has been the practice to locate the knot plate holes very closely to the outer periphery of the knot plate, in many cases to facilitate the pivotal adjustment of the wire bristles relative to the knot plate. Industrial cup-shaped brushes sometimes operate at very high speeds of rotation so that the wire bristles tend to pivot outwardly relative to the knot plate due to centrifugal force. Industrial cup-shaped brushes are also sometimes used in scrubbing applications where the brush is not rotated, but it is mounted on a fixture and used in a scrubbing motion against a surface so that the forces generated will tend to pivot the bristles relative to the knot plate in both inward and outward directions, depending on the direction of movement of the brush relative to the surface to be scrubbed.

In order to hold the bristles in proper position, it has been the practice to sandwich the knot plate and the inner ends of the bristles anchored to the knot plate between inner and outer cups. This sandwich construction not only increases the weight and cost of the brush, but in addition, it requires the provision of means for fastening the sandwich construction together. The industrial cup-shaped brush of the present invention utilizes a knot plate in which the knot holes through which the wire bristles are looped are spaced apart from the outer periphery of the knot plate by a distance substantially greater than the thickness of the knot plate, thereby providing elongated supports for the wire bristles which resist their pivotal movement in both the inward and outward directions relative to the axis of the brush. The bristles looped through the holes on the knot plate are bent sharply within the hole so that the inner and outer portions of the bristles intermediate the knot hole and the outer periphery of the knot plate lie closely to the respective surfaces of the knot plate. The bristles are then twisted tightly beyond the outer periphery of the knot plate, thereby forming elongated loops of substantially complementary shape to the elongated supports on the knot plate. This arrangement holds the bristles in proper position and permits the cup-shaped brush to be used at high speeds of rotation and in scrubbing applications without undesirable inward and outward deflection relative to the axis of the brush and, in some applications, without the need for either outer or inner cups to resist pivotal movement of the wire bristles relative to the knot plate.

The industrial cup-shaped brush of the present invention is a novel, simplified and less costly brush in which both inward and outward pivotal movements of the bristles caused by scrubbing or rotary motions is effectively resisted by providing elongated supports on the knot plate for the wire bristles and anchoring the bristles to the elongated supports by elongated loops of generally complementary shape to the elongated supports.

In the preferred industrial cup-shaped brush of the present invention the knot plate and bristles are mounted within an outer cup from which the bristles extend outwardly. The central portions of the outer cup and knot plate are affixed together, such as by spot welding, and the outer periphery of the knot plate is spaced in relation to the inner surface of the outer cup both to accommodate the loops of the bristles and to hold the brushes in tight engagement with said inner surface for effectively resisting pivotal rotation of the bristles relative to the knot plate in an outward direction.

The elimination of the inner cup dispenses with the need for rivet fastening means and permits the knot plate and outer cup to be spot welded together, a simple and inexpensive way of fastening the parts together.

For a full understanding of the present invention, reference can be made to the detailed description which follows and to the accompanying drawings, in which.

Figure 1:
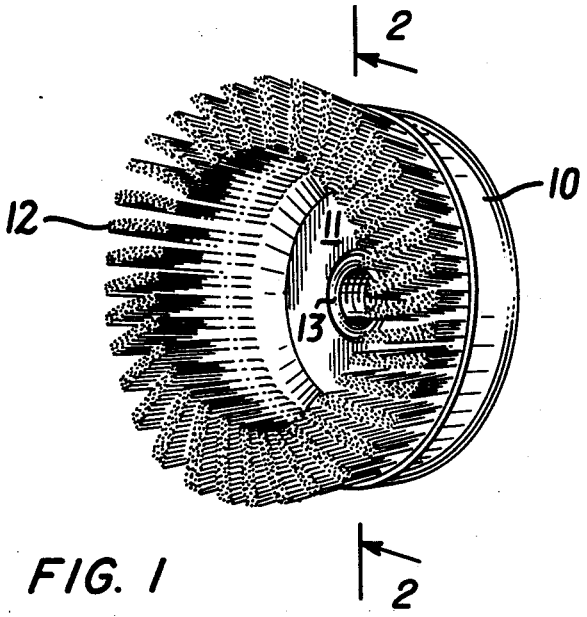
FIG. 1 is a perspective view of the preferred embodiment of the industrial cup-shaped brush of the present invention.
Figure 2:
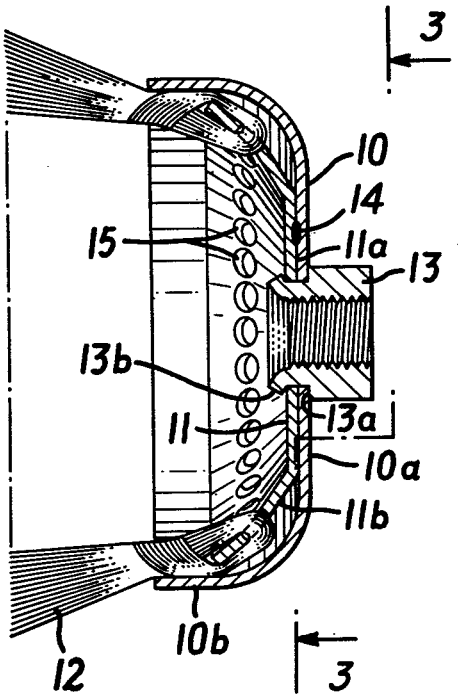
FIG. 2 is a cross-sectional view taken along the line 2—2 of FIG. 1 looking in the direction of the arrows.
Figure 3:
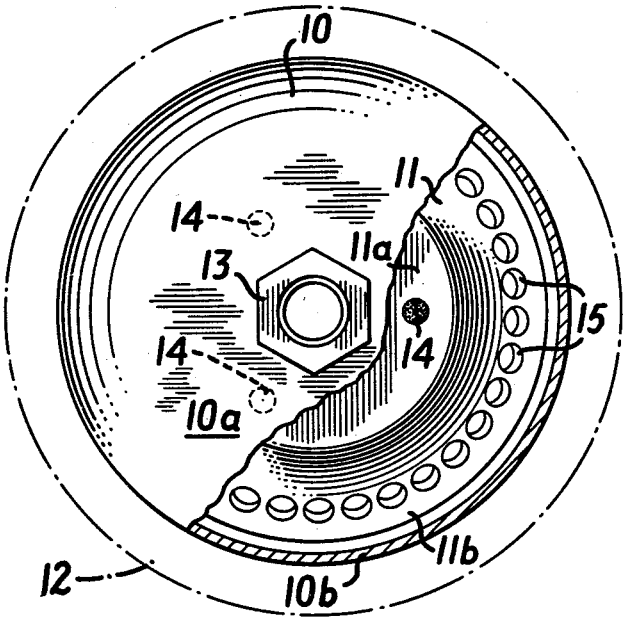
FIG. 3 is a plan view of the brush viewed generally along the lines 3—3 of FIG. 2 with part of the outer cup broken away.

Referring to FIGS. 1 to 3 of the drawings, the cup-shaped brush of the present invention includes an outer cup 10, a knot plate 11 within and attached to the outer cup and a circular array of bristles supported by the knot plate 11. An internally threaded nut or collar 13 is mounted on the cup to attach the brush to a rotary tool. The nut or collar 13 has a shoulder **13*a* which engages the outer surface of the cup 10 and the inner end of the nut or collar passes through central holes in the cup and knot plate and is locked in place by an outwardly flared end 13*b***.

The cup 10 has a central portion **10*a* and an outer portion 10*b* which extends substantially perpendicular to the central portion. The knot plate 11 has a central portion 11*a* attached to the central portion of the cup by spot welds 14 and an outer sloped portion 11*b* having a plurality of holes 15 through which the wire bristles 12** are looped and knotted.

The holes 15 are spaced apart from the outer periphery of the knot plate by a distance which is greater than the thickness of the knot plate, for example, double or greater. By tightly knotting the bristles to the knot plate, that is to say, by looping the bristles through the holes of the knot plate and sharply bending them within the holes so that the bristles lie closely against the inner and outer surfaces of the knot plate between the knot holes and the outer periphery of the knot plate and then twisting the bristles beyond the outer periphery of the knot plate to form elongated loops of substantially complementary shape to the elongated supports of the knot plate, the freedom of the bristles to pivot relative to the knot plate when subjected to external force will be greatly diminished. Also, by extending the outer perimeter of the knot plate to a position closely spaced to the outer portion **10*b*** of the cup, the knotted portions of the bristles will be held against the inner surface of the cup so that pivotal movement of the bristles relative to the knot plate due to external force will be resisted.

This arrangement of mounting the bristles to resist pivotal movement during operation dispenses with the need for a reinforcing inner cup which, in turn, permits the knot plate to be spot welded to the outer cup, a simple and inexpensive attachment.

In a particular embodiment of the invention, a knot plate of 12 gauge steel (0.105 in.) was employed to anchor steel bristles composed of 130 strands of 0.014" wire or 40 strands of 0.023" wire in a cup of 12 gauge steel (0.105 in.) about 4¾ in. in diameter. Such brushes can be operated at well over 6000 rpm without damage to the cup.

Figure 4:
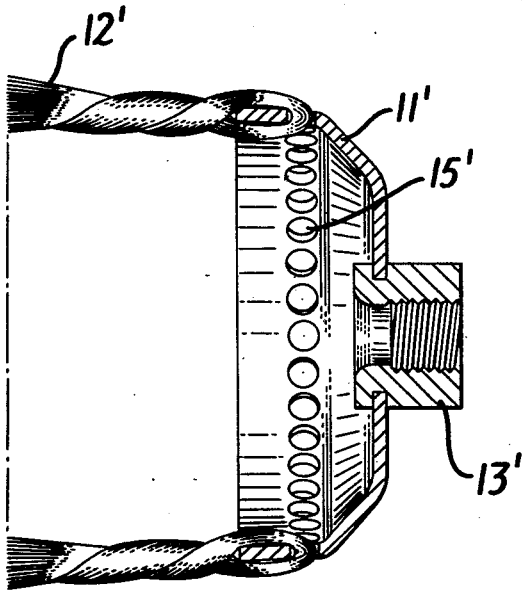
FIG. 4 is a cross-sectional view similar to FIG. 2 of an embodiment of the industrial cup-shaped brush in which both the outer and inner cups are eliminated.

In the alternative embodiment shown in FIG. 4, the outer cup 10 is eliminated and the cup brush comprises the cup-shaped knot plate 11' having bristles 12' tightly knotted through the holes 15' of the knot plate. An internally threaded nut or collar 13' is mounted at the center of the knot plate to attach the brush to a rotary tool.

The invention has been shown and described in preferred forms and by way of example and many variations and modifications can be made therein within the spirit of the present invention. For example, more than one row of knots may be incorporated in the brush. The invention is not intended to be limited to any specified form or embodiment, except in so far as such limitations are expressly set forth in the claims.

I claim:

1. An industrial wire cup-shaped brush comprising a knot plate having a central portion and an outer cup-shaped peripheral portion, a plurality of knot holes uniformly spaced apart in the peripheral portion of the knot plate, the distance between the outer peripheries of the holes in the knot plate and the outer periphery of the knot plate being at least double the thickness of the knot plate to form a plurality of elongated bristle supports, and a plurality of wire bristles looped through the knot holes and twisted beyond the outer periphery of the knot plate and extending beyond the outer periphery of the knot plate to form a circular array of bristles, the portions of the bristles within the knot holes being sharply bent so that the inner and outer portions of the bristles intermediate the knot hole and the outer periphery of the knot plate lie closely to the respective surfaces of the knot plate, the bristles being twisted tightly beyond the outer periphery of the knot plate to form elongated loops of generally complementary shape to the elongated supports on the knot plate, thereby holding the bristles in proper position and resisting pivotal movement of the bristles relative to the knot plate when the brush is subjected to high centrifugal forces at high speeds of rotation and when the brush is used in scrubbing applications.

2. An industrial wire cup-shaped brush as set forth in claim 1 including an outer cup having a central portion and an outer portion which extends substantially perpendicular to the central portion and substantially beyond the outer periphery of the knot plate, means affixing the central portions of the outer cup and knot plate, the portion of the knot plate between the central portion and the outer periphery being spaced from the cup to accommodate the loops of the bristles and the outer periphery of the knot plate extending toward but spaced apart from the inner surface of the outer cup and terminating in closely spaced relation thereto to hold the portions of the bristles intermediate the outer periphery of the knot plate and the open end of the outer cup in engagement with the inner surface of the cup to resist pivotal rotation of the bristles in an outward direction relative to the outer cup and knot plate, the generally complementary shapes of the elongated bristle supports on the knot plate and the bristle loops anchored to the knot plate effectively resisting pviotal rotation of the bristles relative to the knot plate in either an outward or inward direction, thereby eliminating the need for reinforcement of the bristles by the presence of an inner cup.

3. An industrial wire cup-shaped brush as set forth in claim 1 in which the means affixing the central portions of the outer cup and knot plate are spot welds.

* * * * *